US005456222A

United States Patent [19]

Schechter

[11] Patent Number: 5,456,222

[45] Date of Patent: Oct. 10, 1995

[54] SPOOL VALVE CONTROL OF AN ELECTROHYDRAULIC CAMLESS VALVETRAIN

[75] Inventor: Michael M. Schechter, Farmington Hills, Mich.

[73] Assignee: Ford Motor Company, Dearborn, Mich.

[21] Appl. No.: 369,459

[22] Filed: Jan. 6, 1995

[51] Int. Cl.[6] ..... F01L 9/02

[52] U.S. Cl. ..... 123/90.12; 123/90.11

[58] Field of Search ..... 123/90.11, 90.12, 123/90.13, 90.15

[56] References Cited

U.S. PATENT DOCUMENTS

| | | | |
|---|---|---|---|
| 3,209,737 | 10/1965 | Omotehara et al. | 123/90.12 |
| 3,455,209 | 2/1967 | Preston et al. . | |
| 3,738,337 | 6/1973 | Massie . | |
| 4,446,825 | 5/1984 | Giardini et al. . | |
| 4,821,689 | 4/1989 | Tittizer et al. | 123/90.12 |
| 4,930,464 | 6/1990 | Letsche | 123/90.12 |
| 5,058,857 | 10/1991 | Hudson . | |
| 5,193,494 | 3/1993 | Sono et al. . | |
| 5,209,453 | 5/1993 | Aota et al. . | |
| 5,255,641 | 10/1993 | Schechter . | |
| 5,275,136 | 1/1994 | Schechter et al. . | |
| 5,335,633 | 8/1994 | Thien | 123/90.12 |
| 5,339,777 | 8/1994 | Cannon | 123/90.12 |
| 5,363,816 | 11/1994 | Yorita et al. | 123/90.12 |
| 5,367,990 | 11/1994 | Schecter | 123/90.12 |
| 5,375,419 | 12/1994 | Wright et al. | 123/90.12 |

*Primary Examiner*—Henry C. Yuen
*Assistant Examiner*—Weilun Lo
*Attorney, Agent, or Firm*—Donald A. Wilkinson; Roger L. May

[57] ABSTRACT

An engine valve assembly (10) within an electrohydraulic camless valvetrain cooperates with a hydraulic system (8) having a low pressure branch (70) and a high pressure branch (68) to selectively open and close engine valve (12). Engine valve (12) is affixed to a valve piston (16) within a piston chamber (18). A volume (42) below piston (16) is connected to high pressure branch (68) and a volume (20) above piston (16) is selectively connected to the high pressure branch (68) or the low pressure branch (70) via a spool valve (34), to effect engine valve opening and closing. A motor (60) effects the movement of the spool valve (34).

12 Claims, 2 Drawing Sheets

104
110
112
100
118
VALVE LIFT
TIME

102
VALVE STROKE
SPOOL VALVE CLOSED
CENTRAL POSITION
108
t
S
114 t
LIFT L
106

116
LIFT L
t

SPOOL VALVE CONTROL OF AN ELECTROHYDRAULIC CAMLESS VALVETRAIN

This application is related to application Ser. No. 08/167,302 filed Dec. 16, 1993, now U.S. Pat. No. 5,375,419; Ser. No. 08/168,343 filed Dec. 17, 1993, now U.S. Pat. No. 5,373,817; Ser. No. 08/227,825 filed Apr. 7, 1994, now U.S. Pat. No. 5,419,301; Ser. No. 08/266,066 filed Jun. 27, 1994, now U.S. Pat. No. 5,410,994; Ser. No. 08/286,312 filed Aug. 5, 1994, now U.S. Pat. No. 5,404,844; and to co-pending applications titled ELECTRIC ACTUATOR FOR SPOOL VALVE CONTROL OF ELECTROHYDRAULIC VALVETRAIN which is Ser. No. 08/369,460, ELECTRIC ACTUATOR FOR ROTARY VALVE CONTROL OF ELECTROHYDRAULIC VALVETRAIN which is Ser. No. 08/369,640, and ROTARY HYDRAULIC VALVE CONTROL OF AN ELECTROHYDRAULIC CAMLESS VALVETRAIN which is Ser. No. 08/369,433, filed herewith.

FIELD OF THE INVENTION

The present invention relates to a system to control intake and exhaust valves in an electrohydraulic camless valvetrain of an internal combustion engine.

BACKGROUND OF THE INVENTION

The increased use and reliance on microprocessor control systems for automotive vehicles and increased confidence in hydraulic as opposed to mechanical systems is making substantial progress in engine systems design possible. One such electrohydraulic system is a control for engine intake and exhaust valves. The enhancement of engine performance to be attained by being able to vary the timing, duration, lift and other parameters of the intake and exhaust valves' motion in an engine is known in the art. This allows one to account for various engine operating conditions through independent control of the engine valves in order to optimize engine performance. All this permits considerably greater flexibility in engine valve control than is possible with conventional cam-driven valvetrains.

One such system is disclosed in U.S. Pat. No. 5,255,641 to Schechter (assigned to the assignee of this invention). A system disclosed therein employs a pair of solenoid valves per engine valve, one connected to a high pressure source of fluid and one connected to a low pressure source of fluid. They are used to control engine valve opening and closing. While this arrangement works adequately, the number of solenoid valves required per engine can be large. This is particularly true for multi-valve type engines that may have four or five valves per cylinder and six or eight cylinders. A desire arises, then, to reduce the number of valves needed in order to reduce the cost and complexity of the system. If each pair of solenoid valves is replaced by a single actuator, then the number of valves is cut in half.

This same patent also disclose using rotary distributors to reduce the number of solenoid valves required per engine, but then employs an additional component rotating in relationship to the crankshaft to properly time the rotary distributors. This tie-in to the crankshaft may reduce some of the benefit of a camless valvetrain and, thus, may not be ideal. Further, the system still employs a separate solenoid valve for high pressure and low pressure sources of hydraulic fluid. A desire, then, exists to further reduce the number of valves controlling the high and low pressure sources of fluid from the hydraulic system.

SUMMARY OF THE INVENTION

In its embodiments, the present invention contemplates a hydraulically operated valve control system for an internal combustion engine. The system includes a high pressure hydraulic branch and a low pressure hydraulic branch, having a high pressure source of fluid and a low pressure source of fluid, respectively. A cylinder head member is adapted to be affixed to the engine and includes an enclosed bore and chamber. An engine is valve shiftable between a first and a second position within the cylinder head bore and chamber, and a hydraulic actuator has a valve piston coupled to the engine valve and reciprocable within the enclosed chamber which thereby formes a first and a second cavity which vary in displacement as the engine valve moves. A spool valve assembly is mounted to the cylinder head member and includes a valve body coupled thereto, with the valve body including a channel. The cylinder head member includes three ports, a first port connecting the valve body to the high pressure branch, a second port connecting the valve body to the low pressure branch and a third port connecting the valve body to the first cavity, with the three ports being oriented such that the valve body can be moved so that the channel is aligned with the third and first ports, the third and second ports or neither the first or second port. The cylinder head member further includes a high pressure line extending between the second cavity and the high pressure branch. The system further includes actuator means for moving the spool valve relative to the three ports.

Accordingly, an object of the present invention is to provide an electrohydraulic camless valvetrain as disclosed in U.S. Pat. No. 5,255,641 to Schechter that provides an improvement in a camless variable valve control system by incorporating a spool valve to control the high and low pressure hydraulic fluid supplied to and drawn from a hydraulic engine valve.

An advantage to the present invention is the reduced cost and complexity of the above noted system by eliminating the need for two solenoid valves per engine valve and employing one spool valve to control an engine valve in a hydraulic system that incorporates a high pressure and a low pressure branch selectively connected to a cavity above a piston mounted on the engine valve.

DETAILED DESCRIPTION OF THE PREFERRED EMBODIMENTS

Figure 1:
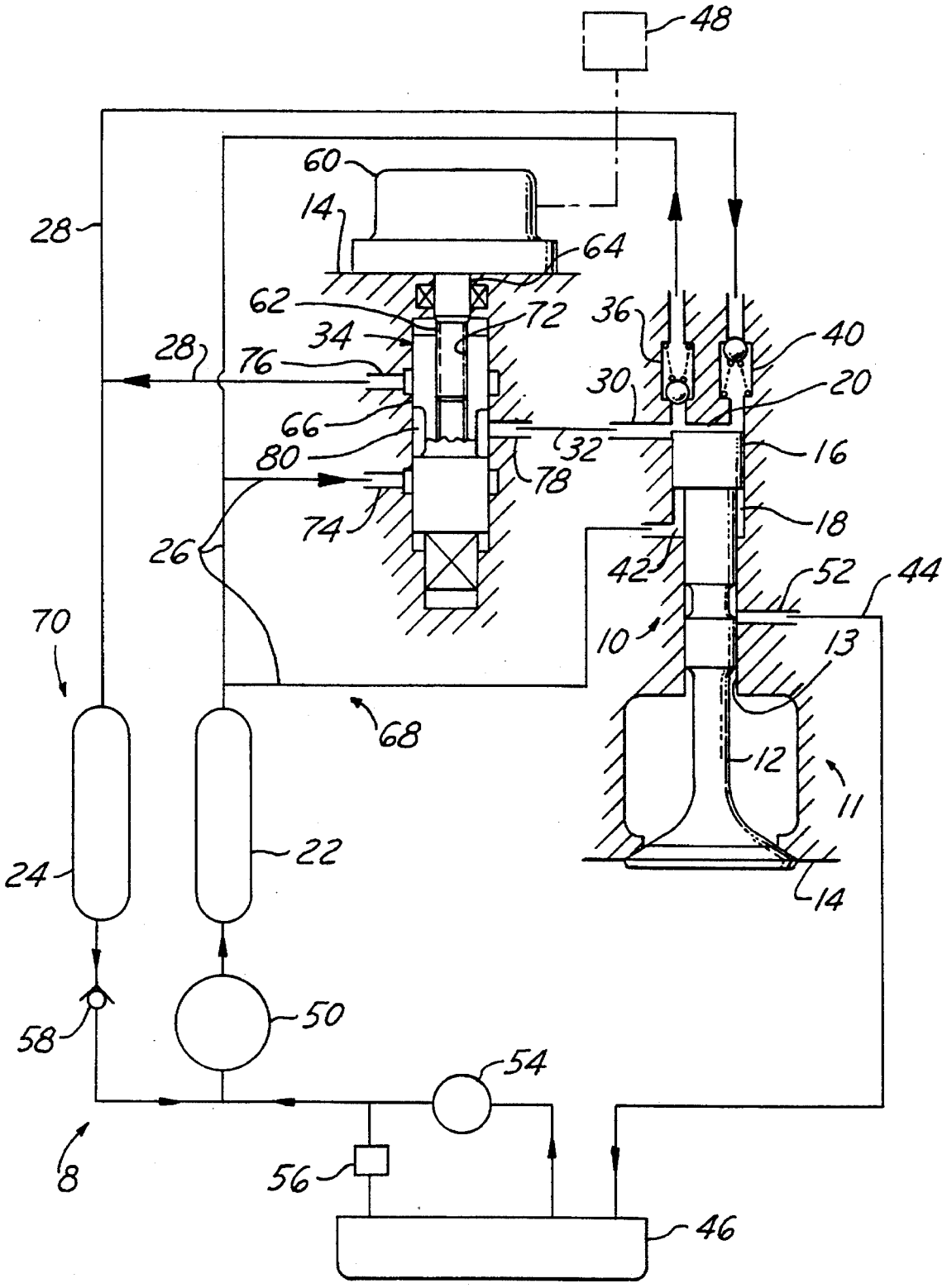
FIG. 1 is a schematic diagram showing a single engine valve, from an engine valvetrain, and an electrohydraulic system for selectively supplying hydraulic fluid to the engine valve.

FIG. 1 shows a hydraulic system 8, for controlling a valvetrain in an internal combustion engine, connected to a single electrohydraulic engine valve assembly 10 of the electrohydraulic valvetrain. An electrohydraulic valvetrain is disclosed in U.S. Pat. No. 5,255,641 to Schechter assigned to the assignee of this invention), which is incorporated herein by reference.

An engine valve 12, for inlet air or exhaust as the case may be, is located within a sleeve 13 in a cylinder head 14, which is a component of engine 11. A valve piston 16, fixed to the top of the engine valve 12, is slidable within the limits of piston chamber 18.

Hydraulic fluid is selectively supplied to a volume 20 above piston 16 through an upper port 30, which is connected to a spool valve 34, via hydraulic line 32. Volume 20 is also selectively connected to a high pressure fluid reservoir 22 through a high pressure check valve 36 via high pressure lines 26, or to a low pressure fluid reservoir 24 via low pressure lines 28 through a low pressure check valve 40. A volume 42 below piston 16 is always connected to high pressure reservoir 22 via high pressure line 26. The pressure surface area above piston 16, in volume 20, is larger than the pressure area below it, in volume 42.

In order to effectuate the valve opening and closing, a predetermined high pressure must be maintained in high pressure lines 26, and a predetermined low pressure must be maintained in low pressure lines 28. The preferred hydraulic fluid is oil, although other fluids can be used rather than oil.

High pressure lines 26 connect to high pressure fluid reservoir 22 to form a high pressure branch 68 of hydraulic system 8. A high pressure pump 50 supplies pressurized fluid to high pressure branch 68 and charges high pressure reservoir 22. Pump 50 is preferably of the variable displacement variety that automatically adjusts its output to maintain the required pressure in high pressure reservoir 22 regardless of variations in consumption, and may be electrically driven or engine driven.

Low pressure lines 28 connect to low pressure fluid reservoir 24, to form a low pressure branch 70 of hydraulic system 8. A check valve 58 connects to low pressure reservoir 24 and is located to assure that pump 50 is not subjected to pressure fluctuations that occur in low pressure reservoir 24 during engine valve opening and closing. Check valve 58 does not allow fluid to flow into low pressure reservoir 24, and it only allows fluid to flow in the opposite direction when a predetermined amount of fluid pressure has been reached in low pressure reservoir 24. From low pressure reservoir 24, the fluid can return directly to the inlet to pump 50 through check valve 58.

The net flow of fluid from high pressure reservoir 22 through engine valve 12 into low pressure reservoir 24 largely determines the loss of hydraulic energy in system 8. The valvetrain consumes oil from high pressure reservoir 22, and most of it is returned to low pressure reservoir 24. A small additional loss is associated with leakage through the clearance between valve 12 and its sleeve 13. A fluid return line 44, connected to a leak-off passage 52, provides a route for returning any fluid which leaks out to an oil sump 46.

The magnitude of the pressure at the inlet to high pressure pump 50 is determined by a small low pressure pump 54 and its associated pressure regulator 56 which supply a small quantity of oil to the inlet of high pressure pump 50 to compensate for the leakage through leak-off passage 52.

In order to control the supply of the high pressure and low pressure fluid to volume 20 above piston 16, hydraulic spool valve 34 is employed. It is actuated by an electric motor 60, shown as a rotary motor, which controls the linear motion and position of spool valve 34. Motor rotation is converted into linear motion of spool valve 34 via threads or helical splines 62 on a central shaft 64, which is coupled to motor 60. Motor 60 is electrically connected to an engine control system 48, which activates it to determine the opening and closing timing. As an alternate, a linear motor, not shown, may be employed instead of a rotary motor. Spool valve 34 would then be attached directly to the motor armature.

A spool valve body 66 is mounted in and rotationally fixed relative to cylinder head 14. It is coupled to central shaft 64 by means of mating internal threads or helical splines 72. With such an arrangement, rotation of central shaft 64 causes linear displacement of spool valve body 66 relative to cylinder head 14. Cylinder head 14 includes three ports; a high pressure port 74 connected between high pressure line 26 and body 66, a low pressure port 76 connected between low pressure line 28 and body 66, and a third port 78 leading from body 66 to volume 20 above engine valve piston 16 via hydraulic line 32. Valve body 66 also includes an annular channel 80 running about its circumference. When valve body 66 is centrally positioned, which is its closed position, spool valve 34 keeps third port 78 disconnected from the other two, 74 and 76. Rotating motor 60 in one direction causes central shaft 64 to rotate, moving spool valve body 66 downward. This connects third port 78 with high pressure port 74 via annular channel 80. Rotation in the other direction causes third port 78 to connect with low pressure port 76 via annular channel 80.

The timing of the process of engine valve opening and closing for the system of FIG. 1 is graphically illustrated in FIGS. 2A–2D. Engine valve opening is controlled by spool valve 34 which, when positioned to allow high pressure fluid to flow from high pressure line 26 into volume 20 via hydraulic line 32, causes engine valve opening acceleration, and, when re-positioned such that no fluid can flow between line 26 and line 32, results in engine valve deceleration. Again re-positioning spool valve 34, allowing hydraulic fluid in volume 20 to flow into low pressure line 28 via hydraulic line 32, causes engine valve closing acceleration, and, when re-positioned such that no fluid can flow between line 28 and 32 results in deceleration.

Figures 2A, 2B, 2C, 2D:
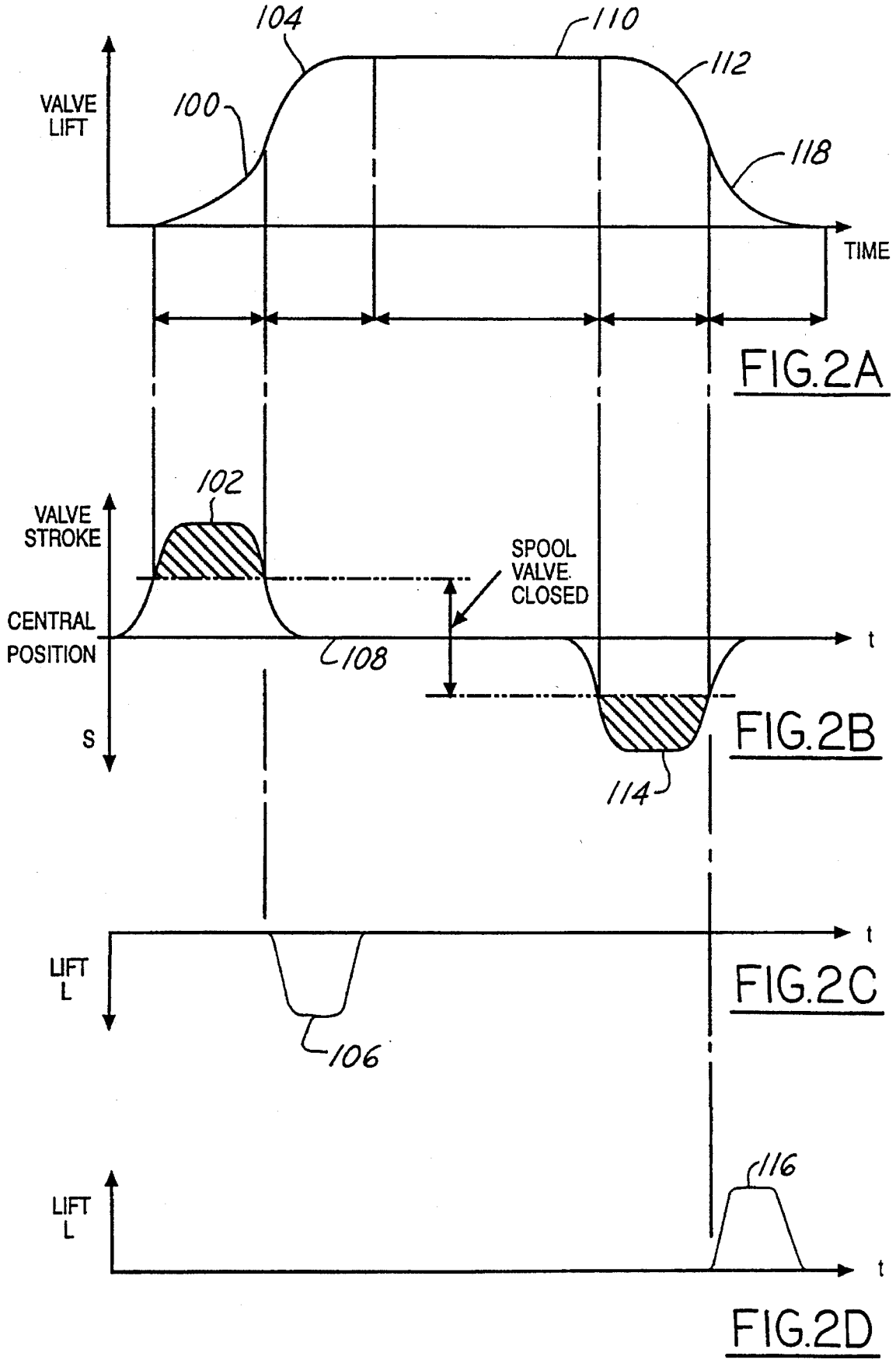
FIGS. 2A–2D are graphs showing the relative timing of the engine valve lift, spool valve movement and the low and high pressure ball check valve opening, respectively.

Thus, to initiate engine valve opening, engine control system 48 activates motor 60 to move spool valve body 66 so that annular channel 80 aligns with high pressure port 74; 102 in FIG. 2B. The net pressure force acting on piston 16 accelerates engine valve 12 downward; 100 in FIG. 2A. Engine control system 48 then reverses the direction of motor 60, so that motor 60 moves spool valve body 66 until annular channel 80 no longer aligns with high pressure port 74, this is the spool valve closed position; 108 in FIG. 2B. The pressure above piston 16 drops, and piston 16 decelerates pushing the fluid from volume 42 below it back through high pressure line 26; 104 in FIG. 2A. Low pressure check valve 40 opens and fluid flowing through it prevents void formation in volume 20 above piston 16 during deceleration; 106 in FIG. 2C. When the downward motion of engine valve 12 stops, low pressure check valve 40 closes and engine valve 12 remains locked in its open position; 110 in FIG. 2A.

The process of valve closing is similar, in principle, to that of valve opening. Engine control system 48 activates motor 60 to move spool valve body 66 so that annular channel 80 aligns with low pressure port 76; 114 in FIG. 2B. The pressure above piston 16 drops and the net pressure force acting on piston 16 accelerates engine valve 12 upward; 112 in FIG. 2A. Engine control system 48 then reverses the direction of motor 60, so that it moves spool valve body 66 until annular channel 80 no longer aligns with low pressure port 76, the spool valve closed position; 108 in FIG. 2B. The pressure above piston 16 rises, and piston 16 decelerates; 118 in FIG. 2A. High pressure check valve 36 opens as fluid from volume 20 is pushed through it back into high pressure hydraulic line 26 until valve 12 is closed; 116 in FIG. 2D.

Varying the timing of spool valve activations varies the timing of the engine valve opening and closing. Valve lift can be controlled by varying the duration of the alignment of annular channel 80 with high pressure port 74. Varying the fluid pressure in high pressure reservoir 22 permits control of engine valve acceleration, velocity and travel time.

During each acceleration of engine valve 12, potential energy of the pressurized fluid is converted into kinetic energy of the moving valve 12 and then, during deceleration, when valve piston 16 pumps the fluid back into high pressure reservoir 22, the kinetic energy is converted back into potential energy of the fluid. Such recuperation of hydraulic energy contributes to reduced energy requirement for the system operation.

While certain embodiments of the present invention have been described in detail, those familiar with the art to which this invention relates will recognize various alternative designs and embodiments for practicing the invention as defined by the following claims.

I claim:

1. A hydraulically operated valve control system for an internal combustion engine, the system comprising:

a high pressure hydraulic branch and a low pressure hydraulic branch, having a high pressure source of fluid and a low pressure source of fluid, respectively;

a cylinder head member adapted to be affixed to the engine and including an enclosed bore and chamber;

an engine valve shiftable between a first and a second position within the cylinder head bore and chamber;

a hydraulic actuator having a valve piston coupled to the engine valve and reciprocable within the enclosed chamber which thereby formes a first and a second cavity which vary in displacement as the engine valve moves;

a spool valve assembly mounted to the cylinder head member including a valve body coupled thereto, with the valve body including a channel;

the cylinder head member including three ports, a first port connecting the valve body to the high pressure branch, a second port connecting the valve body to the low pressure branch and a third port connecting the valve body to the first cavity, with the three ports being oriented such that the valve body can be moved so that the channel is aligned with the third and first ports, the third and second ports or neither the first or second port, with the cylinder head member further including a high pressure line extending between the second cavity and the high pressure branch; and actuator means for moving the spool valve relative to the three ports.

2. A hydraulically operated valve control system according to claim 1 wherein the actuator means comprises a rotary motor and a central threaded shaft coupled thereto, with the central threaded shaft coupled to the spool valve such that rotation of the shaft in one direction will cause the spool valve to move a in first direction and rotation of the shaft in the opposite direction will cause the spool valve to move in a direction opposite to the first direction, to selectively couple the first cavity with the high pressure branch and the low pressure branch.

3. A hydraulically operated valve control system according to claim 2 further including control means cooperating with the rotary motor for selectively coupling the first cavity to the high pressure and low pressure branches via the spool valve body to oscillate the engine valve in timed relation to engine operation, where during each oscillation, some of the high pressure fluid used to reciprocate the engine valve is returned to the high pressure source, thereby allowing that the net fluid flow between the high pressure and low pressure sources may be substantially less than a volume swept by the valve piston.

4. A hydraulically operated valve control system according to claim 3 further including a high pressure check valve mounted between the first cavity and the high pressure source of fluid.

5. A hydraulically operated valve control system according to claim 4 further including a low pressure check valve mounted between the first cavity and the low pressure source of fluid.

6. A hydraulically operated valve control system according to claim 5 wherein the surface area of the valve piston exposed to the first cavity subjected to fluid pressure is larger than the surface area of the valve piston exposed to the second cavity subjected to fluid pressure.

7. A hydraulically operated valve control system according to claim 1 further including a high pressure check valve mounted between the first cavity and the high pressure source of fluid.

8. A hydraulically operated valve control system according to claim 1 further including a low pressure check valve mounted between the first cavity and the low pressure source of fluid.

9. A hydraulically operated valve control system according to claim 1 wherein the surface area of the valve piston exposed to the first cavity subjected to fluid pressure is larger than the surface area of the valve piston exposed to the second cavity subjected to fluid pressure.

10. A hydraulically operated valve control system for an internal combustion engine, the system comprising:

a high pressure hydraulic branch and a low pressure hydraulic branch, having a high pressure source of fluid and a low pressure source of fluid, respectively;

a cylinder head member adapted to be affixed to the engine and including an enclosed bore and chamber;

an engine valve shiftable between a first and a second position within the cylinder head bore and chamber;

a hydraulic actuator having a valve piston coupled to the engine valve and reciprocable within the enclosed chamber which thereby formes a first and a second cavity which vary in displacement as the engine valve moves;

a spool valve assembly mounted to the cylinder head member including a valve body coupled thereto, with the valve body including a channel;

the cylinder head member including three ports, a first port connecting the valve body to the high pressure branch, a second port connecting the valve body to the low pressure branch and a third port connecting the valve body to the first cavity, with the three ports being oriented such that the valve body can be moved so that the channel is aligned with the third and first ports, the third and second ports or neither the first or second port, with the cylinder head member further including a high pressure line extending between the second cavity and the high pressure branch;

a rotary motor and a central threaded shaft coupled thereto, with the central threaded shaft coupled to the spool valve such that rotation of the shaft in one direction will cause the spool valve to move a first direction and rotation of the shaft in the opposite direction will cause the spool valve to move in a direction opposite to the first direction, to selectively couple the first cavity with the high pressure branch and the low pressure branch;

a high pressure check valve mounted between the first cavity and the high pressure source of fluid; and a low pressure check valve mounted between the first cavity and the low pressure source of fluid.

11. A hydraulically operated valve control system according to claim 10 further including control means cooperating with the rotary motor for selectively coupling the first cavity to the high pressure and low pressure branches via the spool valve body to oscillate the engine valve in timed relation to engine operation, where during each oscillation, some of the high pressure fluid used to reciprocate the engine valve is returned to the high pressure source, thereby allowing that the net fluid flow between the high pressure and low pressure sources may be substantially less than a volume swept by the valve piston.

12. A hydraulically operated valve control system according to claim 10 wherein the surface area of the valve piston exposed to the first cavity subjected to fluid pressure is larger than the surface area of the valve piston exposed to the second cavity subjected to fluid pressure.

* * * * *